United States Patent [19]

Krug et al.

[11] 4,336,883

[45] Jun. 29, 1982

[54] INSULATED CONTAINER

[75] Inventors: James E. Krug, Irvine; Roger W. Magenau, Tustin; Jack P. Hall, Palo Alto, all of Calif.

[73] Assignee: Divajex, Tustin, Calif.

[21] Appl. No.: 157,511

[22] Filed: Jun. 9, 1980

[51] Int. Cl.[3] ..... A45C 11/20; F25D 3/08; B65D 81/18

[52] U.S. Cl. ..... 206/545; 190/49; 62/371; 62/457; 220/306; 220/339

[58] Field of Search ..... 206/545, 523, 1.5; 190/49, 51, 57; 220/306, 339; 62/371, 457

[56] References Cited

U.S. PATENT DOCUMENTS

| | | | |
|---|---|---|---|
| 2,496,296 | 2/1950 | Lobl | 62/371 |
| 3,138,254 | 6/1964 | Knapp | 206/545 |
| 3,391,765 | 7/1968 | Baker | 190/49 |
| 3,436,932 | 4/1969 | Paquin | 62/457 |

*Primary Examiner*—William T. Dixson, Jr.
*Attorney, Agent, or Firm*—Gordon L. Peterson

[57] ABSTRACT

An insulated container comprising first and second container sections. Each of the container sections includes a frame section and a housing section of foam plastic mounted on the frame section. A hinge couples the frame sections together for hinged movement between a closed position and an open position. A thermal pack is mounted within the container. A latch releasably holds the container sections in the closed position, and a handle is coupled to the frame sections to facilitate carrying of the insulated container.

10 Claims, 9 Drawing Figures

Fig. 4
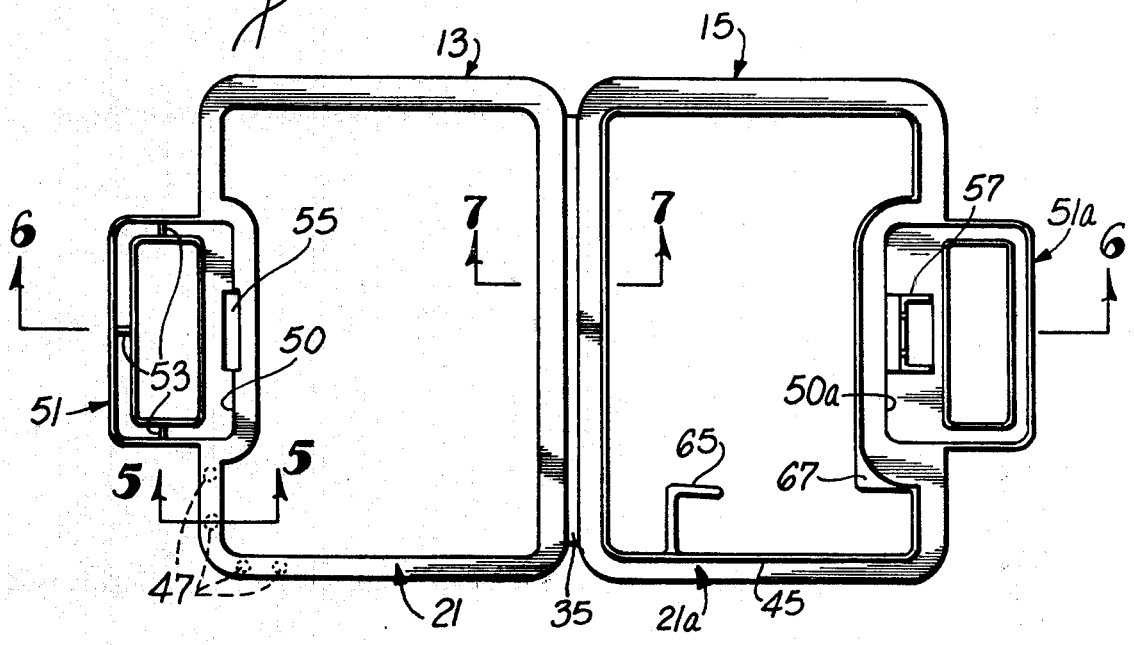
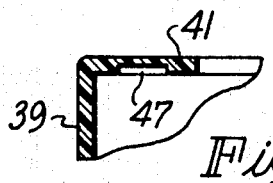
Fig. 5
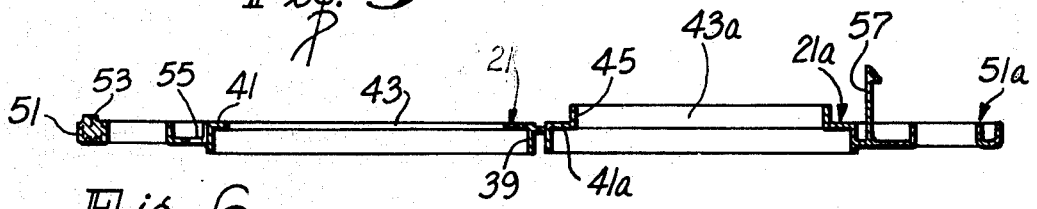
Fig. 6
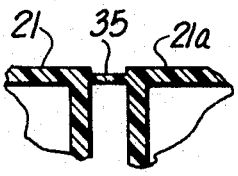
Fig. 7
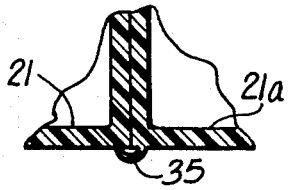
Fig. 8

INSULATED CONTAINER

BACKGROUND OF THE INVENTION

This invention relates to a portable insulated container, and more particularly to an insulated lunch box which is particularly adapted for keeping food and beverages either hot or cold.

A typical lunch box includes a metal container having a lid hinged to the container to permit the lunch box to be opened and closed. Such a lunch box is not insulated but may include a retainer for retaining an insulated beverage container within the lunch box.

Various forms of plastic insulated containers are also known. For example, Conklin U.S. Pat. No. 4,065,336 shows a portable insulated plastic container having refrigerant gel in the lid to keep beverages cold. Although this container is very suitable for picnics and the like, it is not sized or constructed for the usual lunch box purposes.

SUMMARY OF THE INVENTION

This invention provides a portable insulated container of novel construction which includes appropriate structure for mounting a thermal pack within the insulated container. The portable insulated container is lightweight, inexpensive, easily constructed and has numerous other advantageous features.

The thermal pack which is retained within the container may be of any appropriate type which can provide heating or cooling for the interior of the container and the container contents. Although the thermal pack may be of the type which contains chemically reactive elements which react either exothermically or endothermically, the thermal pack is preferably a refrigerant gel pack. Such a pack includes refrigerant gel which can be refrigerated to a temperature well below the freezing point of water and then used to provide heat absorption within the container. To facilitate cooling of the thermal pack in a refrigerator or freezer, the thermal pack is preferably removably mounted within the container.

In a preferred construction, the portable insulated container includes first and second container sections, with each of the container sections including a frame section, a housing section of foam plastic and means for mounting the housing section on the frame section of the associated container section. The foam plastic is a good insulating material and possesses the additional advantages of being lightweight and relatively inexpensive.

Hinge means is coupled to the frame sections to join the container sections for hinged movement between a closed position in which the first and second container sections define an essentially closed chamber and an open position in which the container sections are separated sufficiently to provide access to the chamber. Latch means releasably holds the container section in the closed position, and handle means is coupled to one of the container sections to facilitate carrying of the insulated container.

The frame sections are preferably stronger, more durable and harder than the foam plastic of the housing section. For example, the frame sections can be constructed of a molded plastic material which fulfills these requirements. Preferably, the frame sections are integrally constructed of a self-hinging plastic material, such as polypropylene. When so constructed, the hinge means may include a portion of the self-hinging plastic material which integrally joins the two frame sections.

One problem, however, with making the frame sections of self-hinging plastic material and the housing sections of foam plastic is that these two materials are difficult to adhesively join together. Specifically, adhesive that will not destroy the foam plastic may not adhere adequately to the polypropylene. This invention solves this problem by providing recesses in the frame sections which open toward the associated housing section. An adhesive is then placed in contact with the housing sections, with the adhesive at least partially filling the recesses in the frame sections. This provides a construction which possesses adequate strength.

Because of the added strength and durability of the frame sections, the latch and handle can advantageously be coupled to the frame sections rather than the foam plastic of the housing sections. In a preferred construction, the handle, latch and thermal pack mounting means are all integral with the frame sections. To maximize the usable volume within the insulated container, the thermal pack is preferably mounted along and contiguous a side wall of the chamber within the insulated container.

In a preferred construction, each of the housing sections forms a receptacle having an opening and an edge substantially circumscribing the opening. The frame sections substantially completely circumscribe the opening.

The invention, together with further features and advantages thereof, may best be understood by reference to the following description taken in connection with the accompanying illustrative drawings.

BRIEF DESCRIPTION OF THE DRAWINGS

FIG. 4 is a top plan view of the container in the open position.

FIG. 5 is an enlarged fragmentary sectional view taken generally along line 5—5 of FIG. 4.

FIG. 6 is a sectional view taken generally along line 6—6 of FIG. 4 showing the frame sections with the housing sections removed.

FIG. 7 is an enlarged fragmentary sectional view taken generally along line 7—7 of FIG. 4 with the housing sections removed.

FIG. 8 is an enlarged fragmentary sectional view similar to FIG. 7 with the container in the closed position.

DESCRIPTION OF THE PREFERRED EMBODIMENT

Figure 1:
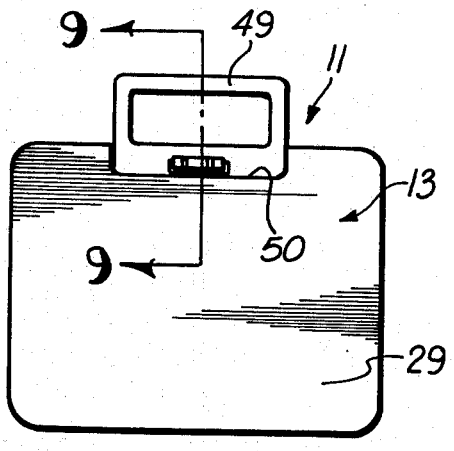
FIG. 1 is a side elevational view of a portable insulated container constructed in accordance with the teachings of this invention.
Figure 2:
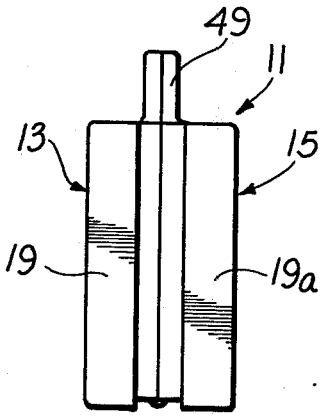
FIG. 2 is an end elevational view of the container.
Figure 3:
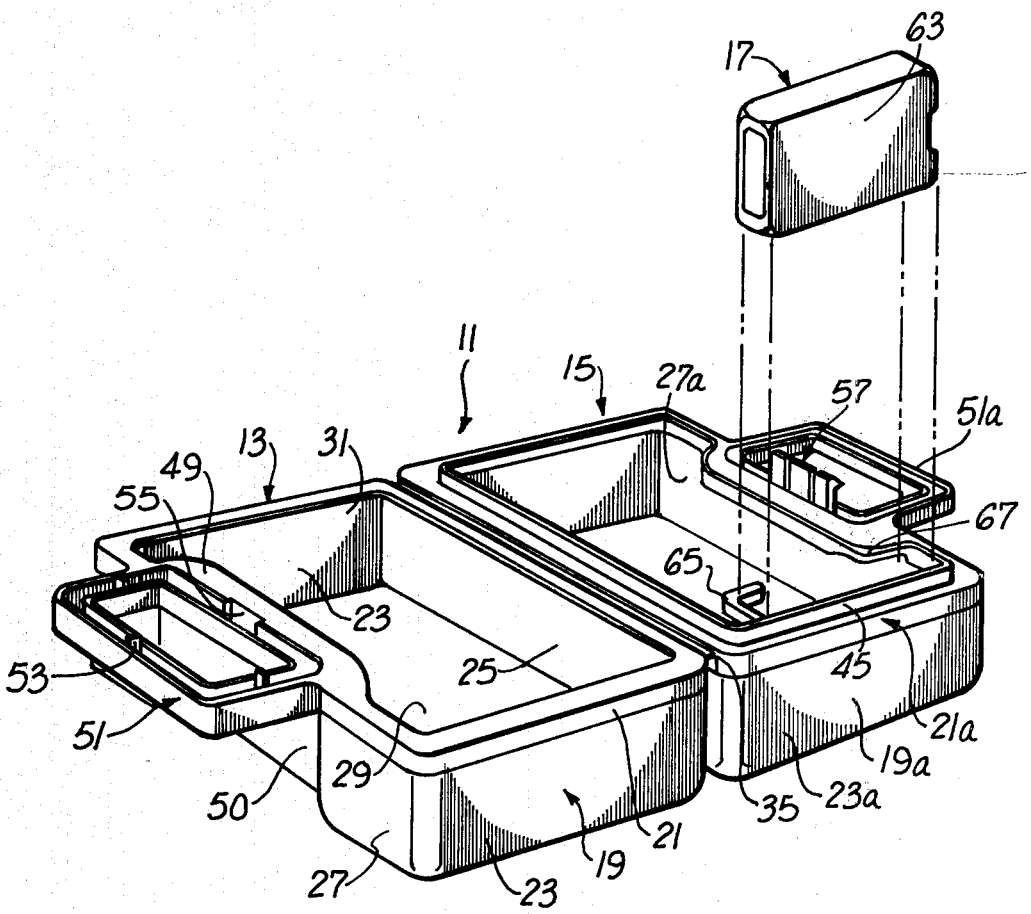
FIG. 3 is a partially exploded perspective view of the container in the open position.

FIGS. 1–3 show a portable insulated container in the form of a lunch box 11, which generally includes first and second container sections 13 and 15 and a thermal pack 17. The container sections 13 and 15 contain many similar components and portions of the container section 15 corresponding to portions of the container section 13 are designated by corresponding reference numerals followed by the letter "a".

The container section 13 includes a housing section 19 and a frame section 21. The housing sections 19 and 19*a* may be identical. The housing section 19 is preferably constructed of a high density foam plastic material, such as polystyrene. For example, a density of about three pounds per cubic foot is preferred.

The housing section 19 includes opposite end walls 23, a bottom wall 25, a top wall 27, and a broad side wall 29 (FIG. 3). The walls 23, 25, 27 and 29 define a receptable having an opening 31 and an edge 33 (FIG. 9) which circumscribes the opening.

The frame sections 21 and 21*a* are preferably integrally molded from a self-hinging plastic material such as polypropylene. When molded in this fashion, the frame sections 21 and 21*a* are integrally joined by a hinge 35 (FIGS. 7 and 8). The hinge 35 enables the container sections 13 and 15 to be pivoted between a closed position (FIGS. 1, 2, 8 and 9) in which the container sections define an essentially enclosed chamber 37 (FIG. 9) and an open position in which the container sections are separated sufficiently to provide access to the chamber as shown, for example, in FIGS. 3 and 4.

The frame section 21 includes an angle section which comprises a leg 39 (FIG. 6) and a flange 41 which is perpendicular to the leg. The leg 39 and the flange 41 define an opening 43. The frame section 21*a* similarly constructed except that it includes a circumscribing lip 45 which extends perpendicular to the flange 41*a* at the opening 43*a*.

Figure 9:
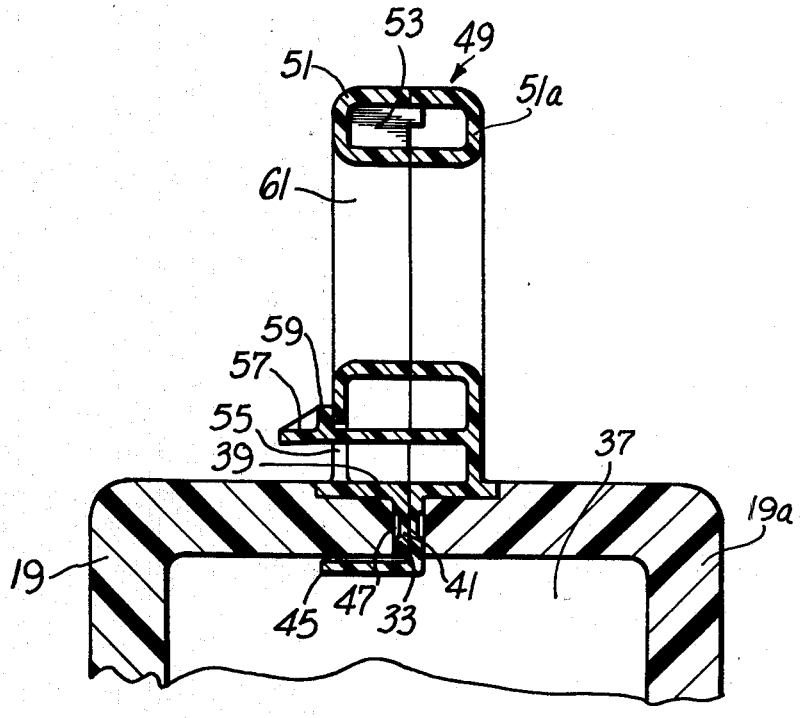
FIG. 9 is an enlarged fragmentary sectional view taken generally along line 9—9 of FIG. 1.

As shown in FIG. 9, the flange 41 overlies the edge 33 of the housing section 19 and is coextensive with the edge 33. The leg 39 is recessed into the periphery of the housing section 19, so that the outer surface of the leg 39 is essentially flush with the outer surface of the housing section 19. The leg 39*a* and the flange 41*a* are similarly arranged with respect to the housing section 19*a*. The lip 45 projects into the interior of the housing section 19 in the closed position to form a seal.

The housing section 19 is adhesively attached to the frame section 21 by an adhesive which extends along the edge 33 and, if desired, along the surface which engages the leg 39. The flange 41 has a plurality of recesses 47 (FIGS. 4, 5, and 9) which is contiguous and which opens toward the edge 33 so that the adhesive can at least partially fill the recesses. This significantly improves the adhesion between the frame section 21 and housing section 19. Any suitable number of the recesses 47 may be used, and if desired, recesses 47 may also be provided on the leg 39. The adhesive is preferably a hot-melt adhesive which will not damage the foam plastic of the housing section 19. The housing section 19*a* is similarly attached to the frame section 21*a*.

The container 11 includes a handle 49 (FIGS. 1, 2 and 9) which is integral with the frame sections 21 and 21*a* and which is located at dished sections 50 and 50*a* in the top walls 27 and 27*a*, respectively. The frame section 21 includes a handle section 51 (FIGS. 4 and 6) of open-sided tubular construction which includes a plurality of locator lugs 53 projecting out of the handle section. The handle section 51 also includes a latch recess 55. The frame section 21*a* has a handle section 51*a* which is identical to the handle section 51 except that it has no locator lugs 53, and it has a resilient slotted latch member 57 in lieu of the latch recess 55.

When the container sections 13 and 15 are in the closed position, the latch member 57 is received within the latch recess 55 as shown in FIG. 9 to releasably hold the container sections in the closed position. The handle sections 51 and 51*a* come together to form the tubular handle 49 as shown in FIG. 9 with the locator lugs 51 being partially received within the open tubular construction of the handle section 51*a* so as to properly align the two handle sections. To open the container section, the resilient latch member 59 is moved downwardly from the position in FIG. 9 until a tab 59 of the latch member can be moved to the right through the latch recess 55. Of course, the handle 49 provides the usual opening 61.

In the embodiment illustrated, the thermal pack 17 (FIG. 3) includes a case 63 filled with refrigerant gel which can be frozen and then used within the lunch box 11 to absorb heat. Although various different constructions can be used, in the embodiment illustrated, the case 17 is constructed of plastic and has adequate rigidity to maintain its configuration.

The thermal pack 17 in the embodiment illustrated, is removably mounted within the lunch box 11 by a hook 65 (FIGS. 3 and 4) integral with the frame section 21*a*, a section of the lip 45, and a shoulder 67 projecting outwardly from the lip 45. The hook 65 is somewhat resilient. The thermal pack 17 is frictionally retained along the end wall 23*a*.

With the lunch box 11 in the open position shown in FIG. 3, the thermal pack 17 can be removed and placed in a freezer to freeze the refrigerant gel. When it is desired to use the lunch box 11, the thermal pack 17 is inserted into the lunch box and held in place by the hook 65 and the cooperating portions of the frame section 21. Food, beverages, and the like can then be placed into the lunch box and the container sections 13 and 15 are pivoted about the hinge 35 to the closed position in which the latch member 57 is lockingly received within the latch recess 55. The items within the container are maintained cool by the absorption of heat by the thermal pack 17. The insulation provided by the foam plastic of the housing sections 19 and 19*a* minimize heat transfer between the chamber 37 and the exterior of the lunch box 11.

Although an exemplary embodiment of the invention has been shown and described, various changes, modifications, and substitutions may be made by those having ordinary skill in the art without necessarily departing from the spirit and scope of this invention.

We claim:

1. A portable insulated container comprising:

first and second container sections;

each of said container sections including a frame section, a housing section of foam plastic and means for mounting the housing section on the frame section of the associated container section;

said frame sections being integrally constructed of self-hinging plastic material, said self-hinging plastic material integrally joining said frame sections of the first and second container sections and defining hinge means for joining said container sections for hinged movement between a closed position in which the first and second container sections define an essentially closed chamber and an open position in which the container sections are separated sufficiently to provide access to said chamber;

latch means for releasably holding the container sections in the closed position;

means on at least one of the container sections for removably mounting a thermal pack;

handle means coupled to at least one of the container sections to facilitate carrying of the insulated container; and said mounting means of said first container section including at least one recess in the frame section of said first container section with said recess being adjacent and opening toward the housing section of the first container section and an adhesive contacting the housing section of the first container section and at least partially filling the recess in the frame section to adhesively attach the foam plastic of the housing section of the first container section to the self-hinging plastic material of the frame section of the first container section.

2. An insulated container as defined in claim 1 wherein at least the housing section of the first container section forms a receptacle having an opening and an edge substantially circumscribing the opening, said frame section of said first container section substantially completely circumscribing the opening.

3. An insulated container as defined in claim 1 wherein said means for mounting the thermal pack is integral with said frame section of the first container section and said insulated container includes a thermal pack retained by the thermal pack mounting means.

4. An insulated container as defined in claim 2 wherein said receptacle has a top wall remote from said hinge means, said top wall having an outwardly opening recess, said handle means being integral with at least one of said frame sections and projecting outwardly from said one frame section adjacent the recess in said top wall at least when the container section is in said closed position.

5. An insulated container as defined in claim 2 wherein the housing section of the second container section forms a second receptable having an opening therein, the frame section of said first housing section including a projecting lip adapted to be received within the second receptable in close proximity to the frame section of said second container section to form at least a partial seal therewith, said thermal pack mounting means including a section of said lip and a hook integral with said frame section of the first container section.

6. A portable insulated container comprising:

first and second container sections;

each of said container sections including a frame section, a housing section of foam plastic and means for mounting the housing section on the frame section of the associated container section;

hinge means coupled to the frame sections for joining said container sections for hinged movement between a closed position in which the first and second container sections define an essentially closed chamber and an open position in which the container sections are separated sufficiently to provide access to said chamber;

latch means for releasably holding the container sections in the closed position;

means on at least one of the container sections for removably mounting a thermal pack;

handle means coupled to at least one of the container sections to facilitate carrying of the insulated container;

at least the housing section of the first container section forming a receptacle having an opening and a edge substantially circumscribing the opening, said frame section of said first container section substantially completely circumscribing the opening, said frame section of said first container section being constructed of plastic material; and said means for mounting the thermal pack being integral with said frame section of the first container section and said insulated container including a thermal pack retained by the thermal pack mounting means.

7. An insulated container as defined in claim 6 wherein said latch means includes a first latch member carried by the frame section of the first container section and a second latch member carried by the frame section of the second container section, said second catch member including a recess for at least partially receiving the first latch member.

8. An insulated container as defined in claim 6 wherein each of said frame sections is constructed of self-hinging plastic material and said hinge means includes said self-hinging plastic material integrally joining said frame sections of the first and second container sections.

9. An insulated container as defined in claim 6 wherein said receptacle has a top wall remote from said hinge means, said top wall having an outwardly opening recess, said handle means being integral with at least one of said frame sections and projecting outwardly from said one frame section adjacent the recess in said top wall at least when the container section is in said closed position.

10. An insulated container as defined in claim 6 wherein the housing section of the second container section forms a second receptacle having an opening therein, the frame section of said first housing section including a projecting lip adapted to be received within the second receptacle in close proximity to the frame section of said second container section to form at least a partial seal therewith, said thermal pack mounting means including a section of said lip and a hook integral with said frame section of the first container section.

* * * * *